US005191993A

United States Patent [19]

Wanger et al.

[11] Patent Number: 5,191,993

[45] Date of Patent: Mar. 9, 1993

[54] DEVICE FOR THE SHIFTING AND TILTING OF A VESSEL CLOSURE

[75] Inventors: Freddy Wanger, Oberrohrdorf; Marcel Refer, Mohnthal; Rainer Schneckenburger, Stein, all of Switzerland

[73] Assignee: Xorella AG, Wettingen, Switzerland

[21] Appl. No.: 840,462

[22] Filed: Feb. 24, 1992

[30] Foreign Application Priority Data

Mar. 4, 1991 [CH] Switzerland ..... 00645/91

[51] Int. Cl.[5] ..... B65D 43/14

[52] U.S. Cl. ..... 220/333; 220/211; 220/319; 220/331; 49/199; 49/360; 49/361

[58] Field of Search ..... 220/211, 263, 319, 320, 220/332, 333, 331; 49/199, 204, 360, 361

[56] References Cited

U.S. PATENT DOCUMENTS

| | | | |
|---|---|---|---|
| 1,819,104 | 8/1931 | Lipovsky | 49/361 |
| 3,119,512 | 1/1964 | Foster | 220/333 |
| 3,195,761 | 7/1965 | Coats | 220/211 |
| 3,302,331 | 2/1967 | Sturm et al. | 220/333 X |
| 3,349,947 | 10/1967 | Zumwalt | 220/366 X |
| 4,334,633 | 6/1982 | Piegza | 220/333 X |
| 4,957,039 | 9/1990 | Reyes | 220/333 X |
| 5,092,963 | 3/1992 | Barker et al. | 220/211 X |

*Primary Examiner*—Allan N. Shoap
*Assistant Examiner*—Nova Stucker
*Attorney, Agent, or Firm*—Schweitzer Cornman & Gross

[57] ABSTRACT

A cylindrical vessel is closed at its end by a cover. To facilitate opening, the cover is tiltably mounted at its sides on supporting blocks. By means of spindles, the two supporting blocks can be raised and lowered. At least one swivel arm is tiltably articulated to the vessel closure and tiltably as well as slideably articulated to the vessel, in such a manner that upon raising of the cover, the latter is at the same time tilted back away from the exposed vessel opening to improve access to the interior of the vessel.

6 Claims, 4 Drawing Sheets

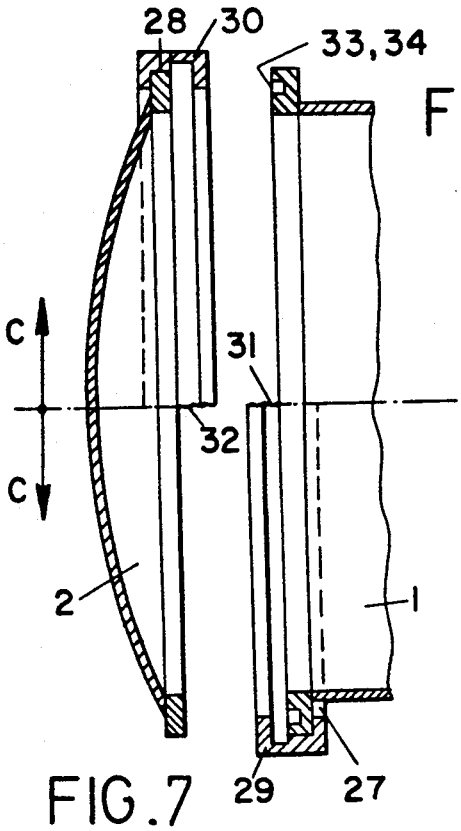
FIG.8
FIG.7
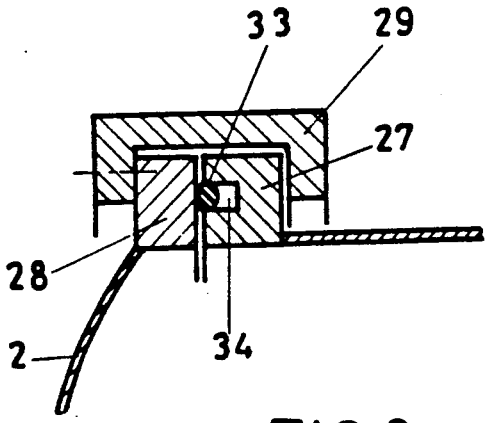
FIG.9
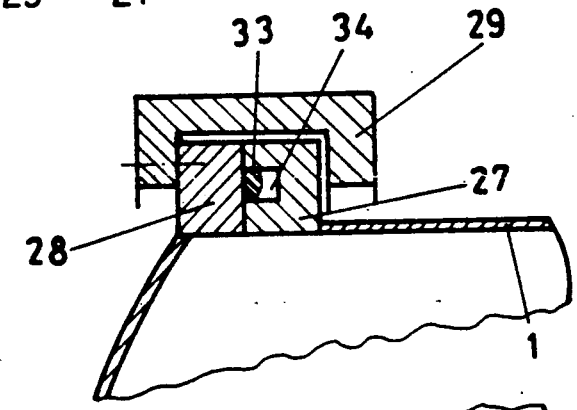
FIG.10
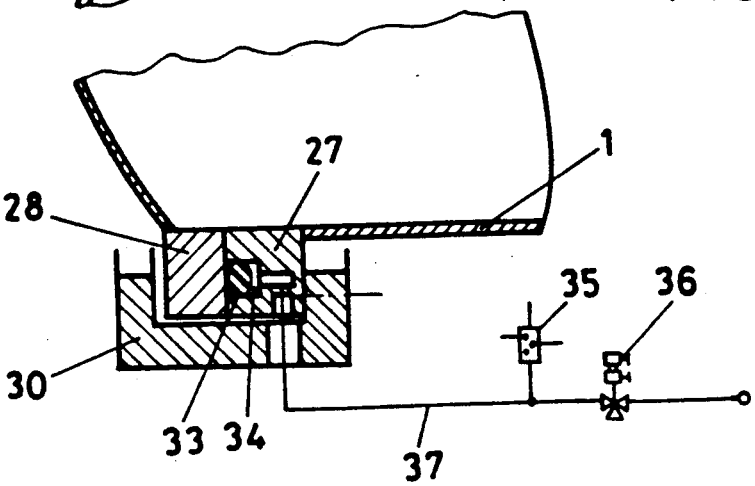

DEVICE FOR THE SHIFTING AND TILTING OF A VESSEL CLOSURE

The present invention relates to a device for shifting and tilting of a vessel closure, especially a vessel cover door providing an opening for a vessel, which may include a locking device for sealing the vessel, whether pressurized or evacuated.

BACKGROUND OF THE INVENTION

A door-opening and closing mechanism for vessels, especially for pressure and vacuum vessels of the type manufactured by Xorella AG of Wettingen, Switzerland, is known. In this known device, the closure mechanism is swiveled about a stationary shaft arranged to be parallel to the vessel axis. In practice, this device has been found to be useful for small vessels with diameters of up to about two meters with correspondingly small covers. With larger vessel diameters, however, space requirements, for instance as to height, are excessive. Also, large torques appear during door operation which act on the vessel and which are liable to lead to its distortion. In addition, with large covers of weights of 2 to 3 tons, the masses and frictional forces involved are large enough to be liable to cause uneven or jerky opening of the cover.

Opening devices for the shifting and tilting of doors are known, for example, in connection with the operation of garage doors which, upon being opened, not only can be swung open like a door but, at the same time, can also be slid away, so that with the doors open, they come to rest against or proximate the garage ceiling.

SUMMARY OF THE INVENTION

It is an object of the invention to provide a device utilizing the space-saving features of a shift and tilt door operator cover without the need of large forces that can produce jerkiness in conjunction with the opening of the cover.

The invention, in achieving this object, is characterized by at least one shifting device for the shifting and unlocking of the vessel closure element after pressure or vacuum in the vessel has been relieved, and by at least one extendable swivel arm for subsequently tilting the unlocked vessel closure away from the entranceway.

The present design has the advantage that, in a preferred embodiment, the large forces required for the opening and closing of the vessel closure are distributed over two spindles and two swivel arms. Single or dual motors may be utilized for reliable synchronous drive of the two spindles. By use of dual motors, use of a relatively expensive angular gear transmission can be avoided.

In a further embodiment of the invention, two spindles, the angular gear transmission and electric motor can be replaced by a hydraulic drive for lifting cylinders.

The swivel arm of the invention is preferably provided with a roller which, over a partial range of the swivel movement of the swivel arm, is supported by a supporting segment. This ensures that the opened vessel closure or cover is reliably supported.

The present design advantageously protects the opened vessel against any undesirable movement, and can be used for vessels both under pressure or vacuum.

A fuller understanding of the present invention for the raising and tilting of a closure will be obtained upon reference to the following detailed description of the invention with the aid of the appended drawings.

BRIEF DESCRIPTION OF THE DRAWINGS

FIG. 7 is a cross-sectional view of a cover with a locking device;

FIG. 8 is a cross-sectional view of a vessel with the corresponding locking device;

FIG. 9 is a detail of the locking device used with a pressurized vessel;

FIG. 10 shows the locking device used with an evacuated vessel;

DETAILED DESCRIPTION OF THE INVENTION

Figure 1:
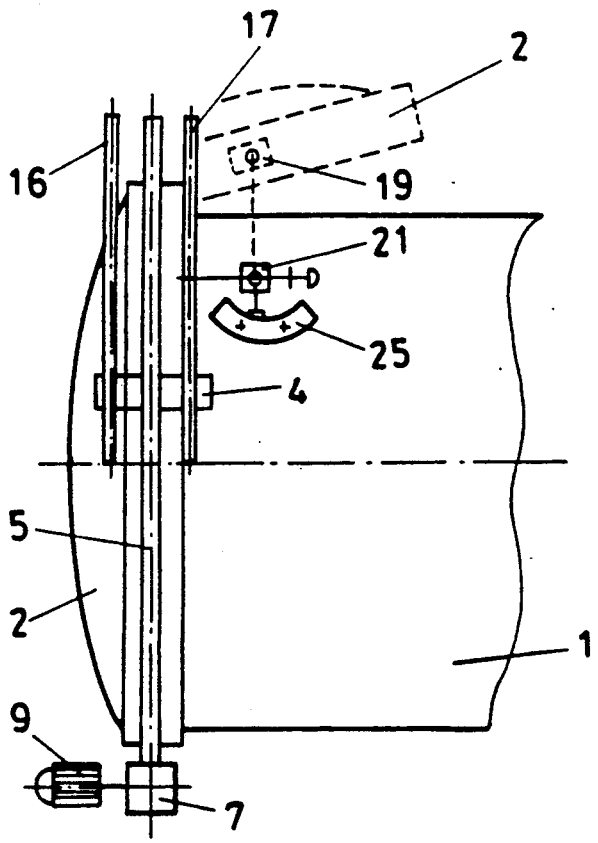
FIG. 1 is a lateral view of the invention for raising of a vessel cover.
Figure 2:
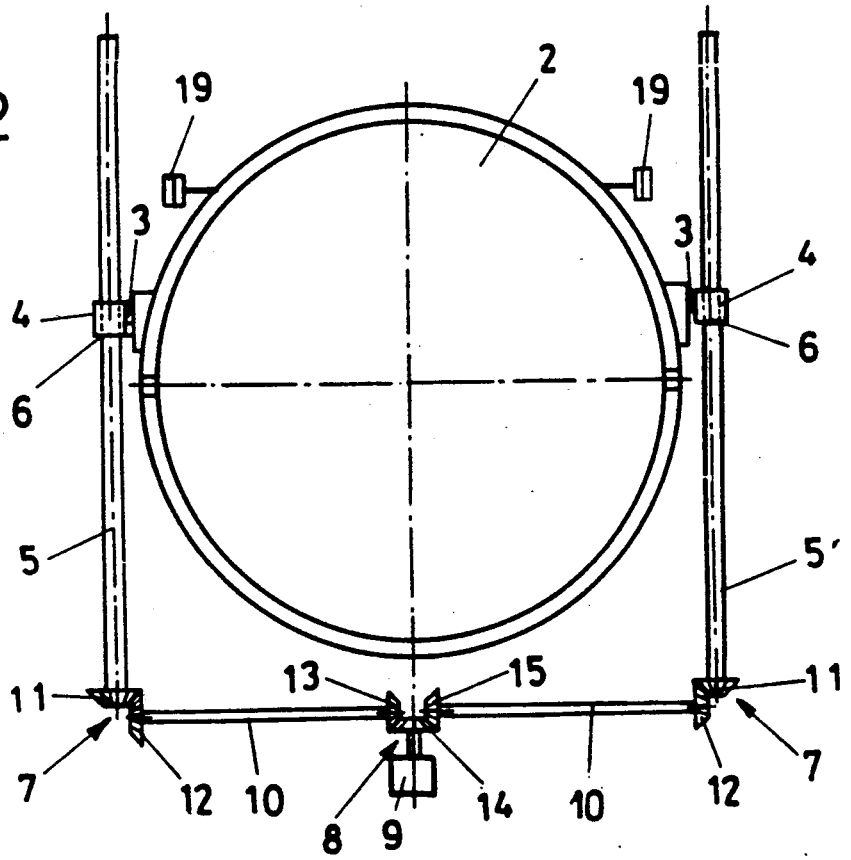
FIG. 2 is a front view of the invention shown in FIG. 1.

As seen in FIGS. 1 and 2, vessel 1 is closed off by a cover 2. As seen in FIG. 2, the cover is mounted on two supporting blocks 4 and can tilt about two pivots 3. With the aid of two threaded spindles 5, the supporting blocks 4 can be raised and lowered. The two threaded spindles are screwed into threaded holes 6 of the blocks 4. By rotating the two threaded spindles 5 together in one direction or the other, the two supporting blocks 4 can thus be raised or lowered, whereby, via the pivots 3, the cover 3 of the vessel 1 is also raised or lowered. An angular gear transmission 7 is attached to the ends of each of the two threaded spindles 5 for rotation of the two threaded spindles 5, the transmissions 7 being driven via a second angular gear transmission 8 by an electric motor 9.

The two angular transmissions 7 are each connected via a shaft 10 to the second angular gear transmission 8. The angular gear transmission 7 consists of two bevel gears 11 and 12, of which the gear 11 is keyed to the threaded spindle 5 and the gear 12 to the shaft 10. The angular gear transmission 8 consists of three bevel gears 13, 14 and 15. The two bevel gears 13 and 15 are keyed to the shafts 10, the third bevel gear 14 is driven by the electric motor 9. The direction of the threads on the spindles 5 are chosen to insure that the supporting blocks 4 raise or lower in unison as the angular gear transmission 8 is energized.

Figure 4:
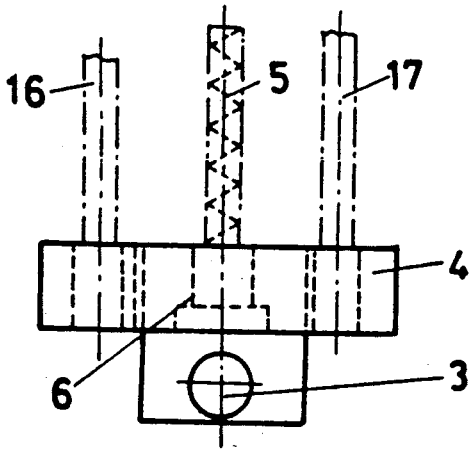
FIG. 4 shows, in lateral view, a detail of the interconnection of the lifting spindles of the invention to the vessel cover as shown in FIG. 1.
Figure 5:
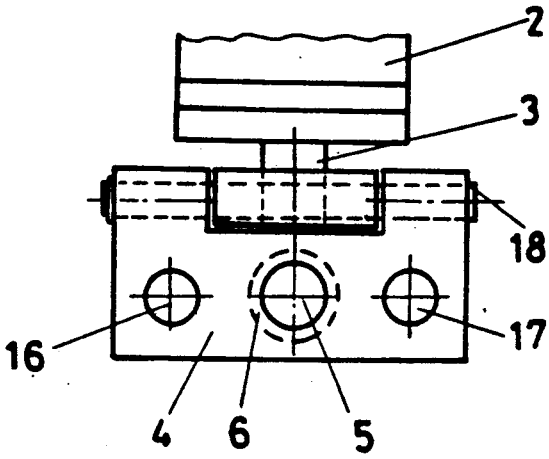
FIG. 5 is a plan view of the detail shown in FIG. 4.

As seen in FIG. 1, each supporting block 4 is slidably mounted on two guide rods 16 and 17 affixed to the cover, as can also be seen in FIGS. 4 and 5. As best seen in FIG. 5, the pivot 3 is rigidly attached to the cover 2 and, via a pin 18, is tiltably mounted in the supporting block 4.

Figure 3:
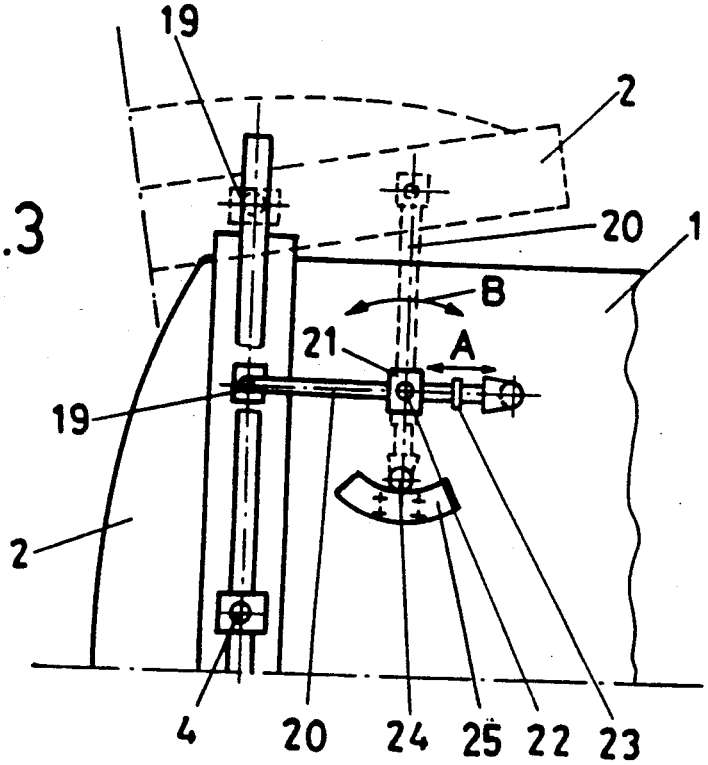
FIG. 3 is a lateral view of the invention detailing the embodiment for tilting the vessel closure upon lift.

As presented in FIG. 3, a swivel arm 20 is tiltably articulated to the cover 2 with the aid of a joint 19. This swivel arm 20 is furthermore slideably articulated to the vessel 1 by means of a second join 21. The swivel arm 20 can be slid through the joint 21 laterally along the length of the vessel in the direction of the arrow A and, at the same time, can also swivel about a perpendicular axis 22 as indicated by the arrow B. The sliding movement of the swivel arm 20 in the joint 21 is limited by a mounted abutment or stop 23.

Figure 6:
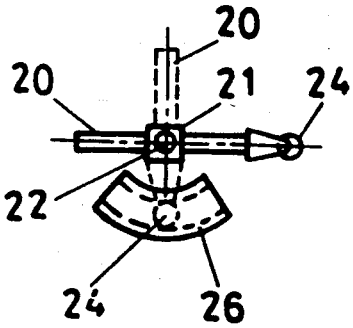
FIG. 6 is a detail of a portion of the tilting apparatus, shown in FIG. 3.

At the right end of the swivel arm 20 there is provided a roller 24. This roller 24 rides upon and is supported by an arculate supporting segment 25 affixed to the vessel when the swivel arm is in the vertical position, as indicated by the dashed lines, in which position the vessel cover 2, also indicated by the dashed lines, is open. As detailed in FIG. 6, the roller 24 of the swivel arm 20 may alternatively be guided in a grooved arcuate guide 26 similarly affixed to the vessel in order to protect the cover 2 in its open position against any undesirable tilting.

In accordance with FIGS. 7 and 8, the vessel cover 2 can be closed upon the vessel 1 in the direction of arrow C (of FIG. 8). A peripheral flange 27 is attached to the vessel 2. This flange extends along the entire circumference of the vessel and has a rectangular cross-section. The cover 1 is similarly provided with a peripheral flange 28 extending along the entire circumference thereof. The two flanges have the same cross-section with parallel abutting faces.

Locking of the device is explained in detail with the aid of FIGS. 7 and 8, and is fully described in Swiss Patent No. CH-A5-420 893. Referring to FIGS. 7 and 8, the cover 2 is removably attached to the vessel 1 by means of two U-shape locking rings 29 and 30 which clasp the two opposed peripheral flanges 27,28. The locking rings 29, 30 constitute two partial rings, each subtending an arc of 180° which complement one another to extend over the entire circumference of the cover opening. Locking ring 29 is preferably attached over its entire length to the upper half of flange 27 of the vessel 1, e.g., by means of a welding seam, while locking ring 30 is preferably attached by means of a similar welding seam along its length to the lower half of flange 28 of the cover 2. Upon mounting of the cover 2, the end faces 31 of the locking ring 29 abut against the end faces 32 of the locking ring 30, whereby the entire circumference of the cover opening is embraced.

As seen in detail in FIGS. 9 and 10, vessel flange 27 is provided with a sealing ring 33. This sealing ring 33 is inserted into a groove in the face of the flange 27 which defines the parting plane between the cover 2 and the vessel 1, and extends about the entire periphery of the flange 27. Between the sealing ring 33 and the flange 27 is a compressed-air space 34. This compressed-air space 34 is produced by cutting the groove for the sealing ring 33 to a depth which exceeds the depth of the inserted portion of the sealing ring 33.

With the cover 2 in position, the sealing ring 33, by applying compressed air into the air space 34, can be slid outwardly in the direction of the longitudinal extent of the vessel 1 to project slightly beyond the face of the flange 27 and produce a seal against the cover flange 28. In accordance with FIG. 10, the applied compressed air can be controlled by a pressure monitor 35 and a solenoid valve 36. The solenoid valve 36 is located in a compressed-air line 37 leading to the compound-air space 34 from an appropriate source.

Figure 11:
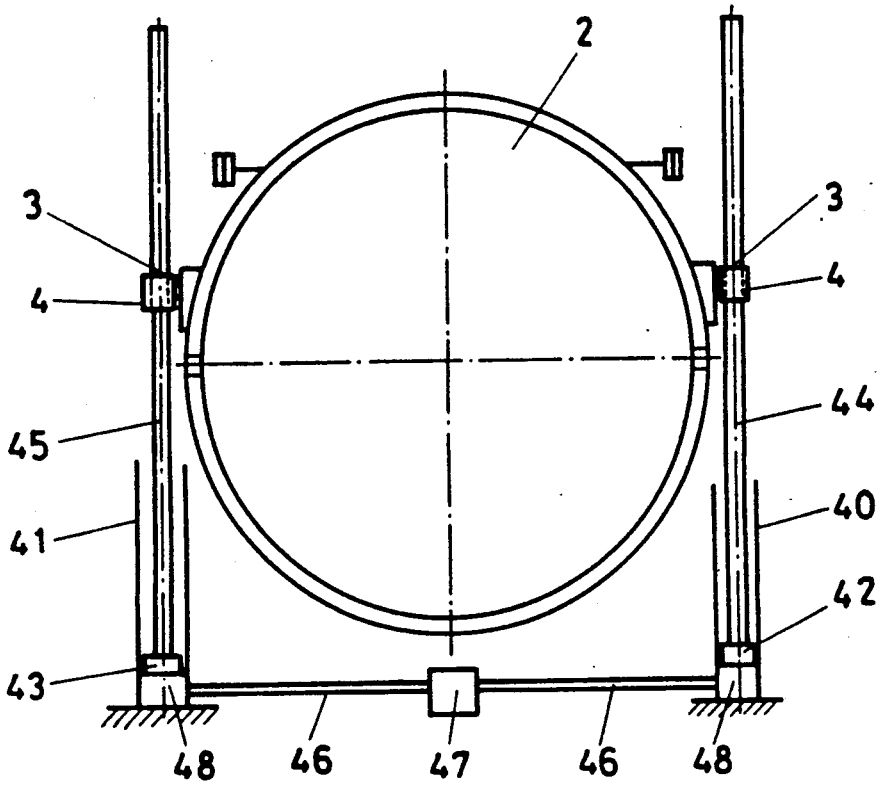
FIG. 11 is a front view of a third embodiment of the invention.

In the embodiment of FIG. 11, the cover 2 is also tiltable about two pivots 3 on supporting blocks 4. The two supporting blocks 4 can be raised and lowered with the aid of two lifting cylinders 40 and 41. The two lifting cylinders 40 and 41 are stationary and include pistons 42 and 43, respectively. By means of piston rods 44 and 45, the pistons 42 and 43 are connected to the supporting blocks 4. Each one of the lifting cylinders 40 and 41 is connected to a hydraulic pump 47, via a hydraulic line 46, so that, upon activation of the pump, pressurized liquid can be fed to the chambers 48 below the pistons 42 and 43. This causes the pistons 42 and 43 to be raised, thus raising the vessel cover 2 via the piston rods 44 and 45 and the supporting blocks 4.

Figure 12:
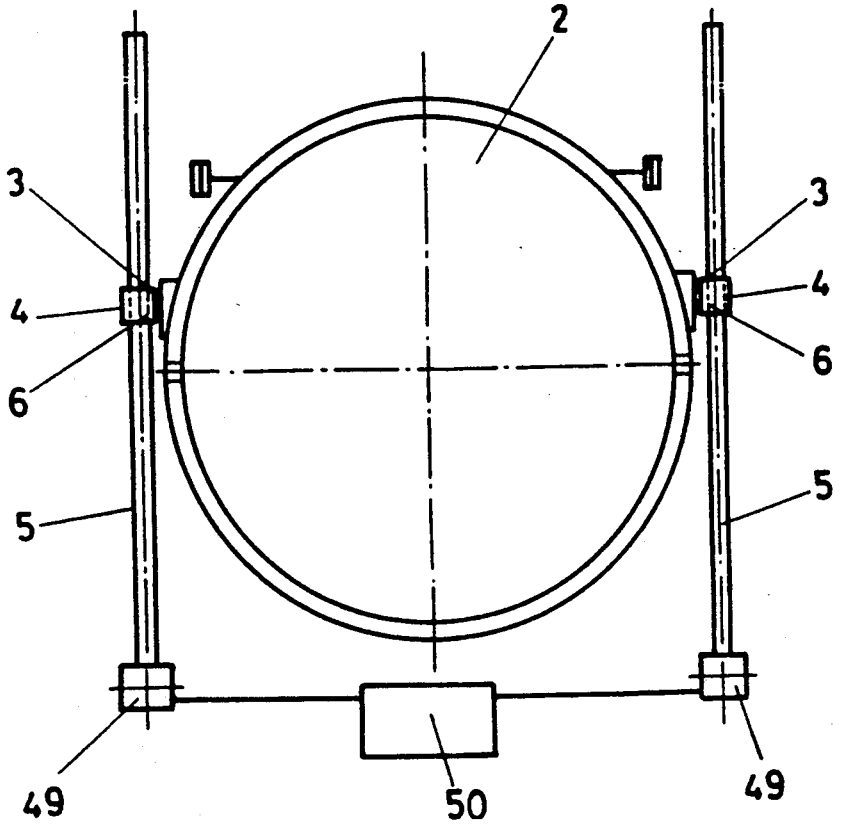
FIG. 12 is a front view of a fourth embodiment of the invention.

In the embodiment of FIG. 12, the cover 2 is similarly tiltable about two pivots 3 on two supporting blocks 4. The two supporting blocks 4 can be raised and lowered by means of two threaded spindles 5. The two threaded spindles 5 are screwed into the threaded holes 6 of the supporting blocks 4. By rotating the threaded spindles 5 in one direction or the other, the two supporting blocks 4 can thus be raised or lowered, thus raising or lowering the cover 2 via pivots 3. An electric motor 49 is arranged at the lower end of each spindle, with the aid of which the two threaded spindles can be driven in either sense of rotation. A per se known control device 50 ensures that the two electric motors 49 will be driven in synchronism. Tilt of the cover may be performed as stated with respect to the embodiment illustrated in FIG. 2.

Opening and closing of the vessel 1 by the cover 2 proceeds in the following manner: Before the cover 2 can be slid off in order to open the vessel 1, the pressure or vacuum prevailing in the vessel 1 must be totally relieved. This may be done in any appropriate manner known in the art. Subsequently, the pressure in the compressed-air space 33, 34 behind the sealing ring 33 must also be relieved, so that the sealing ring 33 is no longer pressed against the peripheral flange 28. For purpose of opening the vessel 1, the cover 2 can be shifted only when the pressure monitor 35 indicates that the line 37 and thus the compressed-air space 34 have been completely vented by the solenoid valve 36.

When venting has been accomplished the cover can be shifted to open the vessel. The motor 9 (or other equivalent drive) is energized, whereupon the cover 2 begins to slide downward in the direction of the arrow C in FIG. 7. In the course of this shifting movement, the upper semicircumferential portion of flange 28 (which is not provided with the cover locking ring 30) is withdrawn downwardly from the locking ring 29 of the vessel 1, while at the same time the lower semicircumferential portion of vessel flange 27 (which is not provided with vessel locking ring 29) is released from the locking ring 30 of the cover 2. With the locking mechanism freed, the cover is shifted slightly to the left on swivel rod 20 of FIG. 3 such that the cover flange 29 clears the vessel flange 30. The cover can then be rotated upwardly away from the vessel entrance, the supporting segment 25 supporting the swivel rod 20 and thus the cover in the open position.

When the vessel 1 is closed by the cover 2, pressure can be built up in the vessel 1, in which case the flanges 27 and 28 will not touch one another, as seen in FIG. 9. Seal is thus created solely by the sealing ring 33. It is also possible to produce a vacuum in the vessel 1, in which case the flanges 27 and 28 are pressed one against the other, as seen in FIG. 10 to generate a seal. In both cases, however, the compressed-air space 34 is put under pressure and the sealing ring 33 is pressed against the flange 28 to ensure a tight seal between the cover 2 and the vessel 1.

Rather than a single motor 9, the two spindles 5 can be driven synchronously by separate motors. Similarly, spindles 5, the supporting blocks 4 with the cover 2 can be raised by two hydraulic or pneumatic cylinders, each having a piston, or with the aid of rack-and-pinion drives, rather than by use of the spindles 5.

A typical vessel 1 may have a diameter of, e.g., 2.7 meters and is constructed to withstand pressures of at least +4 bar and a corresponding vacuum of −1 bar without deformation. The length of the vessel may be, for example, between 2 and 10 meters. For reasons of mechanical strength, the cover 2 is not flat, but crowned as known in the art. The sealing ring 33 between the vessel 1 and the cover 2, i.e. between the peripheral flange 27 of the vessel 1 and the peripheral flange 28 of the cover 2, is preferably a so-called O-ring made of rubber or of a suitable synthetic material, e.g., synthetic rubber. Electric or hydraulic motors are suitable for the shifting and tilting of the vessel cover 2, the size of which depends on the weight of the cover 2. The pressure prevailing in the compressed-air space 34 behind the sealing ring 33 is, e.g., between 1 and 8 bar.

We claim:

1. A device for the shifting and tilting of a vessel closure having a locking device to seal the vessel under pressure or vacuum, comprising at least one shifting means mounted to the vessel closure for shifting and unlocking the closure after pressure or vacuum in the vessel has been relieved and at least one swivel arm mounted to said vessel closure and vessel for the tilting of the unlocked vessel closure, said at least one swivel arm being journaled to said vessel to permit both rotation and transverse motion of said at least one swivel arm, said at least one swivel arm having a first end and a roller mounted to said end, said vessel having an arcuate support for supporting said roller over at least a part of the range of rotation of said at least one swivel arm.

2. The device according to claim 1, wherein said at least on shifting means comprises a first and second spindle located on opposite sides of said vessel closure from each other and coupled to said closure, spindle drive means coupled to said spindles for driving said spindles synchronously, said at least one swivel arm comprises a first and second swivel arm, said swivel arms being located on opposites sides of said vessel closure from each other, said swivel arms being tiltably articulated to the vessel closure and tiltably and slideably articulated to the vessel.

3. The device according to claim 2, wherein said spindle drive means comprise a common motor coupled to said spindles though an angular transmission gear.

4. The device according to claim 2, wherein said spindle drive means comprise a separate motor coupled to each spindle, said separate motors being adapted to rotate in synchronism with each other.

5. The device accordingly to claim 1, wherein said at least one shifting means comprises a first and second hydraulic lifting cylinder, said hydraulic lifting cylinders being located on opposite sides of said vessel closure from each other and being coupled to vessel closure shifting piston.

6. The device according to claim 2 further comprising a roller mounted to each of said swivel arms, grooved guides mounted to said vessel for supporting said roller over at least a part of the range of swivel movement of said swivel arms.

* * * * *